US008932143B2

(12) United States Patent
Pyrce et al.

(10) Patent No.: US 8,932,143 B2
(45) Date of Patent: Jan. 13, 2015

(54) CONTROL SYSTEM FOR A CHILD SWING

(71) Applicant: Mattel, Inc., El Segundo, CA (US)

(72) Inventors: Philip R. Pyrce, Getzville, NY (US); James P. Meade, Hamburg, NY (US); Mark Alan Wollen, Poway, CA (US); James Paul Baker, La Mesa, CA (US); James A. Bishop, Jr., North Tonawanda, NY (US); Ross Allan Niver, Newfane, NY (US)

(73) Assignee: Mattel, Inc., El Segundo, CA (US)

( * ) Notice: Subject to any disclaimer, the term of this patent is extended or adjusted under 35 U.S.C. 154(b) by 93 days.

(21) Appl. No.: 13/650,254

(22) Filed: Oct. 12, 2012

(65) Prior Publication Data

US 2014/0106891 A1 Apr. 17, 2014

(51) Int. Cl.
*A63G 9/16* (2006.01)
*A47D 9/02* (2006.01)

(52) U.S. Cl.
USPC ..... 472/119; 5/108

(58) Field of Classification Search
CPC ..... A47D 9/02; A47D 9/04; A47D 13/10; A63G 9/16; A63H 29/22; A63H 33/26
USPC ..... 472/118, 119; 297/273, 274; 446/227; 5/101, 108, 109
See application file for complete search history.

(56) References Cited

U.S. PATENT DOCUMENTS 3,579,268 A 5/1971 Steiger
3,922,602 A 11/1975 Lunquist
3,947,742 A 3/1976 van Acker
4,038,588 A 7/1977 Woolfson
4,157,507 A 6/1979 Desai
4,308,500 A 12/1981 Avins
4,331,263 A 5/1982 Brown
4,395,665 A 7/1983 Buchas
4,442,532 A 4/1984 Takemura
4,628,314 A 12/1986 Morinaga
4,952,080 A 8/1990 Boiucaner
5,525,113 A 6/1996 Mitchell
5,574,339 A 11/1996 Kattwinkel
6,339,304 B1 1/2002 Allison
6,544,128 B1 4/2003 Yang
6,683,543 B1 1/2004 Yeo
6,692,368 B1 2/2004 Hyun
6,814,670 B2 * 11/2004 Morita et al. ..... 472/119
6,824,473 B2 11/2004 Wu
7,329,192 B2 2/2008 Gibree
7,712,831 B2 5/2010 Abt et al.

(Continued)

OTHER PUBLICATIONS

International Search Report issued in PCT/US2013/063189, dated Jan. 8, 2013.

*Primary Examiner* — Kien Nguyen
(74) *Attorney, Agent, or Firm* — Edell, Shapiro & Finnan LLC

(57) ABSTRACT

A control system for a child swing that comprises an amplitude control subsystem configured to use one or more electrical signals from a swing sensor to compare an actual amplitude of the child swing to a pre-set amplitude of the child swing to generate an adjustment signal representing a desired adjustment to the phase of the drive mechanism. The child swing also comprises a phase control subsystem configured to use an electrical signal representative of a phase of the drive mechanism and the adjustment signal to generate a motor drive signal configured to cause the desired adjustment to the phase of the drive mechanism.

30 Claims, 9 Drawing Sheets

(56) References Cited

U.S. PATENT DOCUMENTS

| | | | | |
|---|---|---|---|---|
| 7,905,791 | B2 | 3/2011 | Guang | |
| 7,959,514 | B2 | 6/2011 | Chen | |
| 8,308,578 | B2 * | 11/2012 | Gilbert et al. | 472/119 |
| 2003/0181249 | A1 | 9/2003 | Meade | |
| 2005/0049055 | A1 | 3/2005 | Publicover | |
| 2009/0131185 | A1 | 5/2009 | Speedie | |
| 2010/0052387 | A1 | 3/2010 | Hopke et al. | |
| 2010/0151951 | A1 | 6/2010 | Gilbert et al. | |
| 2011/0059806 | A1 | 3/2011 | Qiu | |
| 2012/0066833 | A1 | 3/2012 | Sclare et al. | |

* cited by examiner

CONTROL SYSTEM FOR A CHILD SWING

FIELD OF THE INVENTION

The present invention generally relates to a child swing that uses a phase control (PC) subsystem and the amplitude control (AC) subsystem-to control the motion of the swing.

BACKGROUND OF THE INVENTION

Child swings are commonly used to entertain children (e.g., infants) and children. Traditionally, a child swing includes a seat which is supported at the distal end of one or more swing arms. The swing arms are configured to swing so that the seat follows an arcuate path.

Various mechanisms (e.g., motors, magnets, etc.) have been proposed to power child swings so that there is no need for a parent or other user to continuously keep the swing in motion. In motor driven swings, an electric motor is mechanically coupled to a swing arm such that a torque output by the motor causes a swinging motion of the swing arm.

Child swings generally include a user interface that allows a user to select one of a plurality of swing height (amplitude) settings. In the case of a motor driven swing, the motor may be provided with a predetermined voltage input that is generated based on the user's amplitude selection. The voltage level provided to the motor determines the speed of the motor and the resulting torque placed on the swing arm, thereby determining the amplitude of the swing.

SUMMARY OF THE INVENTION

The present invention relates to a control system for a child swing. The control system comprises two major subsystems, namely a phase control (PC) subsystem and an amplitude control (AC) subsystem. The phase control subsystem is configured to compare the phase of the swing arm to the phase of the drive mechanism. The phase control subsystem is further configured to generate, based on this comparison, a motor drive signal configured to adjust the speed of the motor to place the drive mechanism in-phase with the phase of the swing arm. The amplitude control subsystem is configured to compare an actual (measured) amplitude of the swing to a pre-set amplitude of the swing. The amplitude control subsystem is further configured to generate, based on this comparison, an adjustment signal that represents a desired adjustment or modification to an actual phase of the drive mechanism. This adjustment signal is then provided to the phase control subsystem for use in generating the motor drive signal. The phase is maintained during operation to avoid poor control, noise and thus customer dissatisfaction. It is to be appreciated that the control system described herein may be used in a number of different swings and can accommodate various weights and seat positions.

In one embodiment, the amplitude control subsystem uses a Proportional/Integral (PI) transfer function is used for amplitude control.

In one embodiment, a proportional integral derivation (PID) transfer function is used for amplitude control.

In one embodiment, the phase control subsystem uses a PI transfer function used for phase control.

In one embodiment, a proportional integral derivation (PID) transfer function is used for phase control.

In one embodiment, the swing sensor is an encoder configured to output two pulse trains representative of the actual amplitude of the child swing and representative of the actual direction of the swing arm.

In one embodiment, the control system further comprises a startup subsystem configured to initiate motion of the swing arm before such time that phase sensing is possible because the swing arm has not started to move above a selected minimum amplitude. In such an embodiment, the amplitude control and phase control subsystems may be disabled until the child swing reaches a predetermined amplitude.

BRIEF DESCRIPTION OF THE DRAWINGS

Like reference numerals have been used to identify like elements throughout this disclosure.

DETAILED DESCRIPTION OF THE INVENTION

Figure 1:
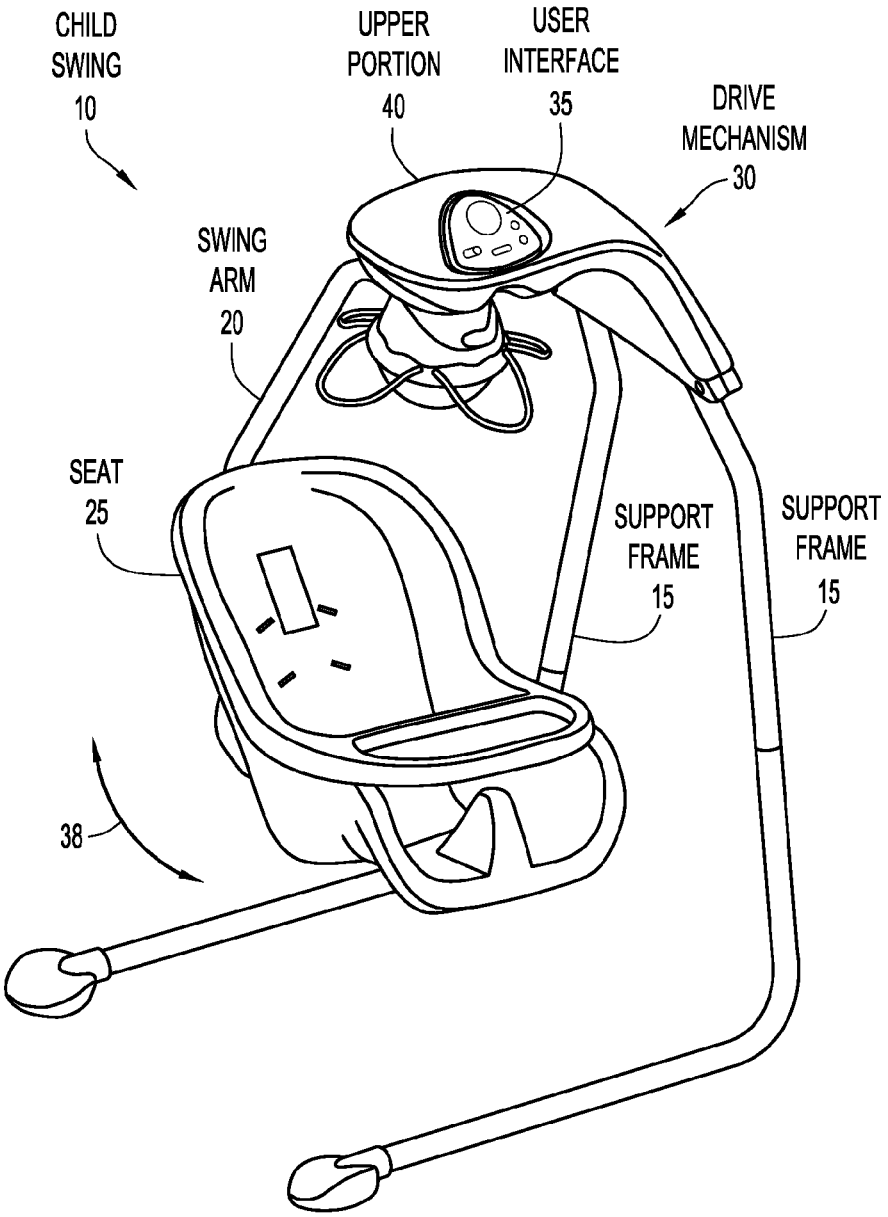
FIG. 1 illustrates a front perspective view of a child swing according to an embodiment of the present invention.

Child swings are generally manufactured such that for a selected swing amplitude (height), the motor will receive a fixed voltage that results in a fixed output torque. However, a child swing operates on the principles of harmonic motion and, as such, the torque required from the motor to maintain a selected child swing amplitude depends on the weight and location of a child in the seat, orientation of the seat to the pendulum, and variation in frictional factors. As a result, under different loading conditions a constant torque applied to the swing arm may produce varying amplitudes for a selected motor speed.

In an attempt to produce a consistent motion profile under different loading conditions, child swings have been developed to include feedback systems that correlate desired swing amplitude to actual swing amplitude. Conventional feedback systems generally detect the current amplitude of the swing and compare it to the desired swing amplitude selected by a user. By comparing the actual swing amplitude with the desired swing amplitude, a controller will adjust the voltage provided to the motor and thus adjust the torque exerted on the swing arm.

Described herein is a control system for a child swing that further improves operation under various loading conditions. The control system comprises an amplitude control (AC) subsystem configured to compare an actual (measured or otherwise determined) amplitude of the swing to a pre-set (selected) amplitude of the swing. The amplitude control subsystem is further configured to generate an adjustment signal representing a desired adjustment to the phase of the drive mechanism. This signal may be, in one example, an advanced swing phase signal in which the actual phase of the swing arm is adjusted or modified based on the comparison of the actual amplitude of the swing to the pre-set amplitude. The control system also comprises a phase control subsystem configured to use the adjustment signal to compare the phase of the swing arm to the phase of the drive mechanism. The phase control subsystem is further configured to generate a motor drive signal configured to cause a desired adjustment to the phase of the drive mechanism. It is to be appreciated that the control system described herein may be used in a number of different swings and can accommodate various weights and seat positions.

It is to be understood that terms such as "left," "right," "top," "bottom," "front," "rear," "side," "height," "length," "width," "upper," "lower," "interior," "exterior," "inner," "outer," "forward," "rearward" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

A control system in accordance with embodiments of the present invention may be used in a wide variety of swings. FIG. 1 is a perspective view of one exemplary child swing 10. In this illustrative arrangement, child swing 10 comprises a support frame 15, a swing arm 20, and a seat 25. A drive mechanism 30 and a user interface 35 are disposed in an upper portion 40 of the support frame 15. In operation, the support frame 15 provides a stable base that allows the seat 25 to follow an arcuate path generally shown in FIG. 1 by arrow 38.

Figure 2:
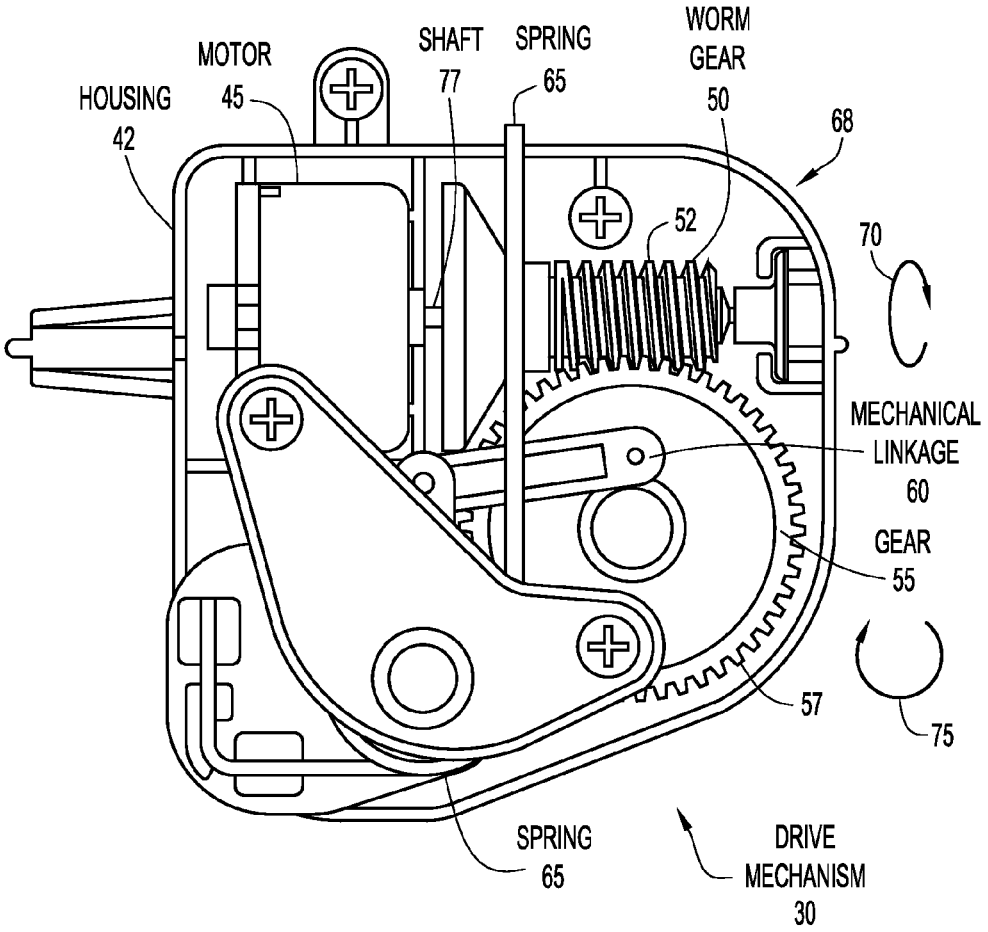
FIG. 2 illustrates a side view of a portion of a drive mechanism for the child swing of FIG. 1.

FIG. 2 is a side view of a portion of the drive mechanism 30 that may be disposed in upper portion 40. The illustrated portion of drive mechanism 30 includes, among other elements, a housing 42, a direct current (DC) motor 45, a worm gear 50, a mating gear 55, a mechanical linkage 60, and a spring bar (spring) 65. Motor 45 is electrically connected to a motor drive (not shown in FIG. 2) and a controller (also not shown in FIG. 2) that processes user inputs received via user interface 35. User interface 35 allows a user (e.g., parent, caregiver, etc.) to select one of a plurality of swing amplitude (also called swing or seat height) settings. In response to an amplitude setting, the controller causes the motor drive to provide the motor 45 with a predetermined voltage input. This voltage input causes the motor 45 to rotate at a predetermined speed and, accordingly, causes worm gear 50 to correspondingly rotate. The general direction of rotation of worm gear 50 is shown by arrow 70.

Worm gear 50 includes a series of teeth 52 that mesh with teeth 57 of mating gear 55. As such, rotation of worm gear 50 in the direction of arrow 70 results in corresponding rotation of mating gear 55 in the direction shown by arrow 75. The rotation of mating gear 55 causes reciprocal motion of mechanical linkage 60 so as to tension spring 65. As described below, spring 65 is coupled to swing arm 20 such that spring-action (tension) of the spring 65 cause corresponding motion of the swing arm 20. The mechanical components connecting the motor 45 to the swing arm 20 (i.e., worm gear 50, mating gear 55, mechanical linkage 60, and spring 65) are collectively referred to as drive components 68.

In the embodiments described herein, swing arm 20 is considered to have two "phases" of operation. The first phase of swing arm 20 occurs when the swing arm 20 moves in a first direction (e.g., forward), while the second phase of swing arm 20 occurs when the swing arm 20 moves in the second, opposite direction (i.e., backward). For example, during the first phase the swing arm 20 swings in a direction to push seat 25 forward. When seat 25 reaches the forward apex, the swing arm 20 reverses to the second phase and, in this example, moves in a direction so that the seat 25 is forced (or freely moves) rearward. The phase of swing arm 20 will again reverse when the seat 25 reaches a rear apex. In other words, swing arm 20 has a reciprocating motion and reverses phase at each apex of seat 25.

It is to be appreciated that the motor 45 may have a number of different configurations. However, in general, motor 45 will include a shaft (axle) 77 that rotates in response to an input voltage. The rotation of shaft 77 causes the corresponding rotation of worm gear 50. In the embodiments described herein, the rotation of mating gear 55 (in response to rotation of worm gear 50) is synchronized with the rotation of the motor 45.

Motor 45 rotates in a 360 degree circle and, accordingly, the drive mechanism 30 can be characterized as having two distinct 180 degree rotational "phases" of operation. The first phase of drive mechanism 30 can be viewed as rotation of shaft 77 from the 0 degree position with respect to a selected reference direction (such as a vertical direction) to a 180 degree position with respect to the selected reference direction. Similarly, the second phase of drive mechanism 30 can be viewed as rotation of shaft 77 from the 180 degree position with respect to the selected reference direction back to the 0 degree position with respect to the selected reference direction.

Figure 3:
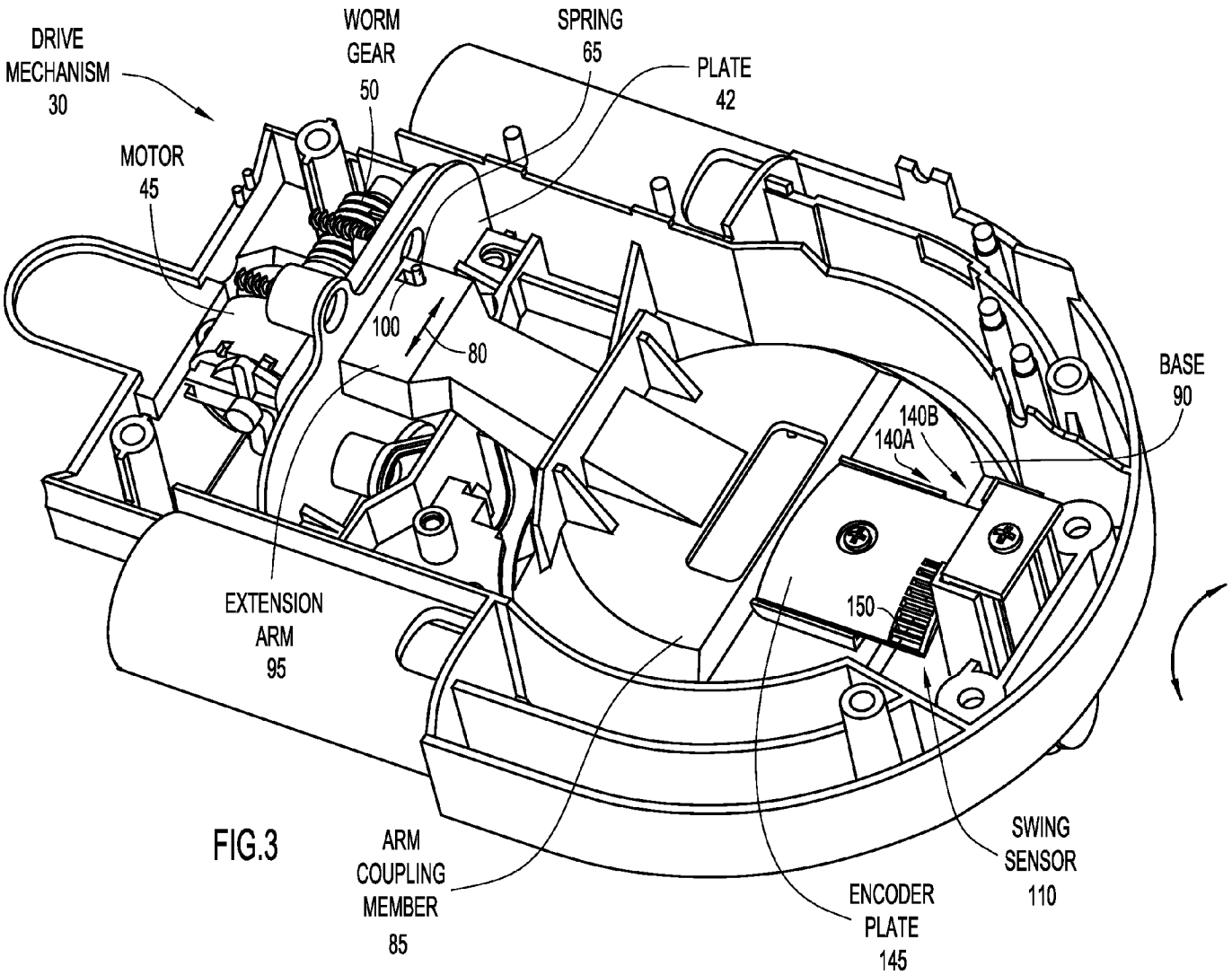
FIG. 3 illustrates a top perspective view of the upper portion of the drive mechanism for the child swing of FIG. 1.

FIG. 3 is a top perspective view of a larger portion of drive mechanism 30. As shown, drive mechanism 30 further comprises an arm coupling member 85 that includes a base 90 and an extension arm 95 that extends distally from the base 90. An aperture 100 is disposed in the distal end of extension arm 95, and the distal end of spring 65 extends through this aperture 100. As noted above, as mechanical linkage 60 reciprocates in response to the rotation of the motor 45, the mechanical linkage 60 places tension on spring 65 which in turn pushes against extension arm 95. Therefore, when the spring 65 is placed under tension, the spring 65 forces against the edge of aperture 100 so as to impart reciprocal motion on extension arm 95 in the direction of arrow 80. This reciprocal motion is then transferred through base 90 to swing arm 20, thereby causing seat 25 to swing back-and-forth in the general direction of arrow 38 (FIG. 1). In other words, the swing arm 20 is forced to move as a result of the spring-action of spring 65 in response to the rotation of motor 45.

As noted above, the actual height of seat 25 (commonly referred to as the swing amplitude) in response to an input voltage to motor 45 may vary depending on, for example, different loading conditions (e.g., different sized children, location of a child in the seat, etc.). In order to produce a consistent motion profile under different loading conditions, child swing 10 includes a control system that, among other uses, is configured to correlate a desired amplitude of the swing with the actual amplitude of the swing, as well as to correlate the phase of the drive mechanism with the phase of the swing arm. In the embodiments described herein, the control system receives signals from two sensors, namely swing sensor 110 (FIG. 3) and drive phase sensor 115 (FIG. 4), each of which is described in greater detail below.

Figure 4:
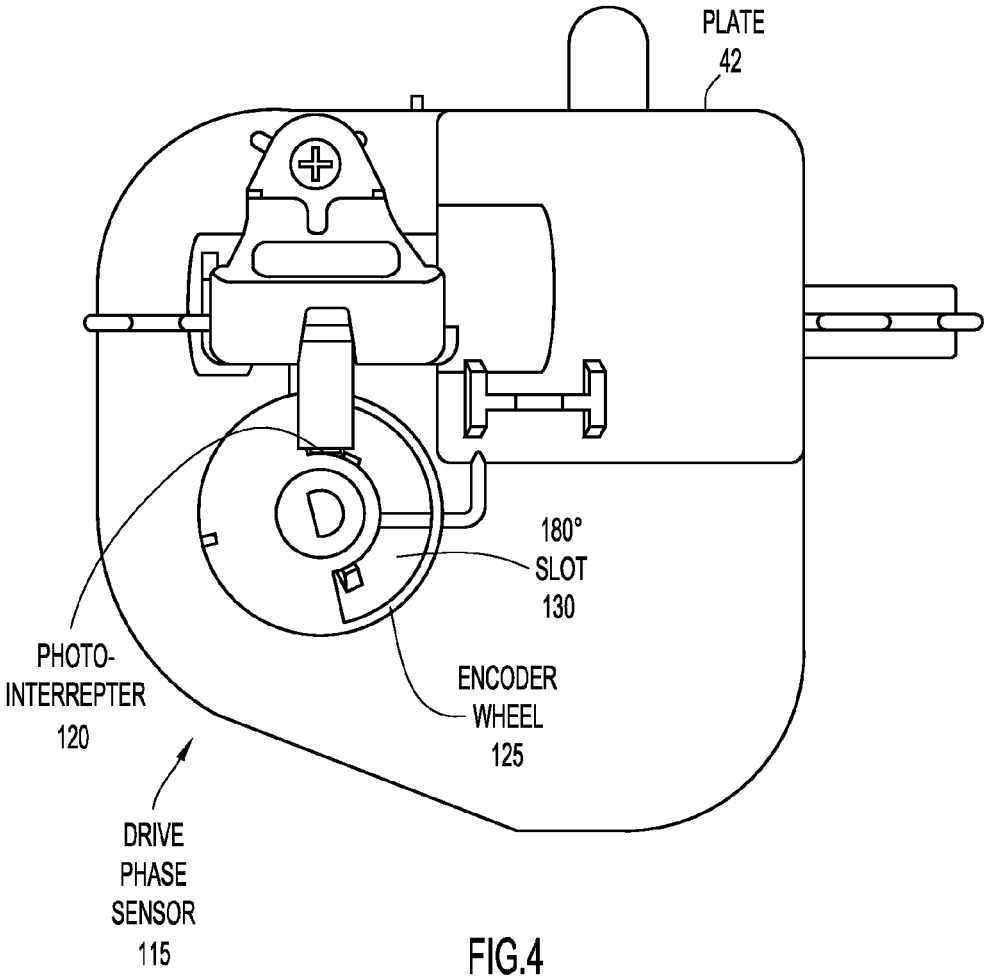
FIG. 4 illustrates a side view of a drive-phase sensor used in the child swing of FIG. 1.

FIG. 4 is a side view of drive-phase sensor system 115 disposed on the opposing side of housing 42 as motor 45. Drive phase sensor 115 includes a photo-interrupter 120 and an encoder wheel 125 with a 180 degree slot 130 disposed therein. In this embodiment, encoder wheel 125 is coupled to gear 55 (FIG. 2) so as rotate therewith. That is, as mating gear 55 rotates in the direction of arrow 75, encoder wheel 125 will also rotate in the same direction and at the same speed. Because mating gear 55 is synchronized to the phases of drive mechanism 30, encoder wheel 125 will also be synchronized to the phases of the drive mechanism. As such, the 180 degree slot 130 enables the photo-interrupter 120 to produce signals that are used by the control system to determine the phase of the drive mechanism 30.

More particularly, photo-interrupter 120 includes, in this example, a photo-emitting device (e.g., Light Emitting Diode (LED), photodiode, etc.) that transmits a beam of light to a photo-receiving device (e.g., phototransistor). The encoder wheel 125 is positioned between the photo-emitting device and the photo-receiving device so that the light beam is only received at the photo-receiving device via the 180 degree slot while the drive mechanism 30 is in a first phase. However, the encoder wheel 125 will block the light beam while the drive mechanism 30 is in the second phase. In this way, depending on whether or not the photo-receiving device detects the light beam, the control system of child swing 10 can determine the phase of drive mechanism 30.

Child swing 10 also includes a swing sensor 110 shown in FIG. 3. In this embodiment, swing sensor 110 is an encoder in which a photo-emitting device transmits a beam of light to two (2) photo-receiving devices via an encoder plate 145. The encoder plate 145 has a plurality of elongate apertures or slots 150 disposed therein, and the encoder plate 145 is coupled to swing arm 20 so as to reciprocate in the direction shown by arrow 155 in synchronization with the swing arm 20. That is, when swing arm 20 changes direction (phase) as described above, the encoder plate 145 will also change direction.

Encoder plate 145 is positioned between the photo-emitting device and the photo-receiving devices so that the light beam is only received at the photo-receiving devices via the slots 150. In other words, swing sensor is configured to obtain two series of light pulses and to output corresponding electrical signals. The slots 150 are sized and spaced so that the control system can determine, based on the resulting electrical signals, (1) the phase (i.e., direction) of swing arm 20 and (2) the amplitude of the swing.

The swing amplitude is regulated by the speed of motor 45. In order to ensure that swing arm 20 smoothly follows the desired arcuate path, the swing arm 20 and the drive mechanism 30 should remain "in-phase." In other words, the phases of swing arm 20 and drive mechanism 30 should maintain a desired alignment. If the drive mechanism 30 were perfectly in phase with the swing arm 20, then the drive mechanism 30 would not be able to add energy to the system and the swing arm 20 would not swing. For example, with a fixed lead angle of 0 degrees (i.e., the motor linkage and swing arm reversing direction simultaneously), no energy is added to the child swing and the swing arm will not move or, if already in motion, will eventually stop.

In order to add energy to the system, the phase of the drive mechanism 30 is "advanced" relative to the phase of the swing arm 20. This "advance" means that the phase of the drive mechanism 30 needs to "lead" the phase of the swing arm 20 by a certain angular amount. For example, with a predetermined angle, the swing will increase to maximum amplitude. The energy added to the swing arm may monotonically increase as the lead angle increases, in this example, from 0 degrees to the predetermined angle.

As used herein, the drive mechanism 30 and swing arm 20 are considered to be "in-phase" when the phase of the drive mechanism 30 leads the phase of the swing arm 20 by the desired angular amount. Therefore, when "in-phase" the drive mechanism 30 and swing arm 20 will rotate/reciprocate at the same speed and their phase transitions (180 degree points) will be aligned (subject to the angular advance of the drive mechanism 30).

A user selects a speed/amplitude setting (e.g., high, medium, low) for the child swing 10 at the user interface 35. This user selection is used to control the speed of the motor 45 and, accordingly, to achieve a desired amplitude. However, child swing 10 operates on the principles of a harmonic motion, and as such, the torque required from the motor 45 to maintain a desired child seat amplitude depends on the weight and location of a child in the seat, orientation of the seat to the pendulum, and variation in frictional factors. As a result, under different loading conditions a constant torque applied to the swing arm may produce varying amplitudes for a selected motor speed.

In accordance with embodiments described herein, the child swing 10 includes a dual-purpose control system that is configured to (1) ensure that the drive mechanism 30 stays in phase with the swing arm 20 and (2) ensure that the actual amplitude of the swing matches the desired amplitude. The dual-purpose control system includes a phase control (PC) subsystem and an amplitude control (AC) subsystem. The phase control subsystem is primarily configured to keep drive mechanism 30 in phase with the swing arm 20. That is, the phase control subsystem is configured to maintain a desired lead angle between the phase of drive mechanism 30 and the phase of swing arm 20, as noted above, or is configured to adjust the phase angle (lessen or increase) as needed to maintain the phase relationship.

The amplitude control subsystem is configured to influence or "steer" the phase control subsystem to match, and maintain a match, of the actual swing amplitude with a desired amplitude set by, for example, a user or auxiliary control system. The AC subsystem measures the current or actual amplitude (using signals received from the swing sensor 110) and compares the actual amplitude against the desired or pre-set amplitude. The amplitude control subsystem then determines if the phase control subsystem needs more or less energy in the system to try to match the actual amplitude with the desired amplitude. The swing amplitude will increase when energy is added to the system and will decrease when energy is removed from the system. Energy is added/removed from the system by increasing/decreasing the lead angle of the drive mechanism 30 relative to the swing arm 20 (i.e., the angle that the phase control subsystem attempts to maintain). Therefore, the amplitude control subsystem steers the phase control subsystem such that an offset will be added or subtracted from the lead angle that the phase control subsystem adjusts in an attempt to maintain the phase relationship between motor 45 and swing arm 20. The system as a whole is, in essence, a two control loop system, where the phase control subsystem attempts to maintain a phase relationship between the drive mechanism 30 and the swing arm 20, and the amplitude control subsystem influences (i.e., steers) the phase control subsystem to match the actual amplitude with a desired amplitude.

Figure 5:
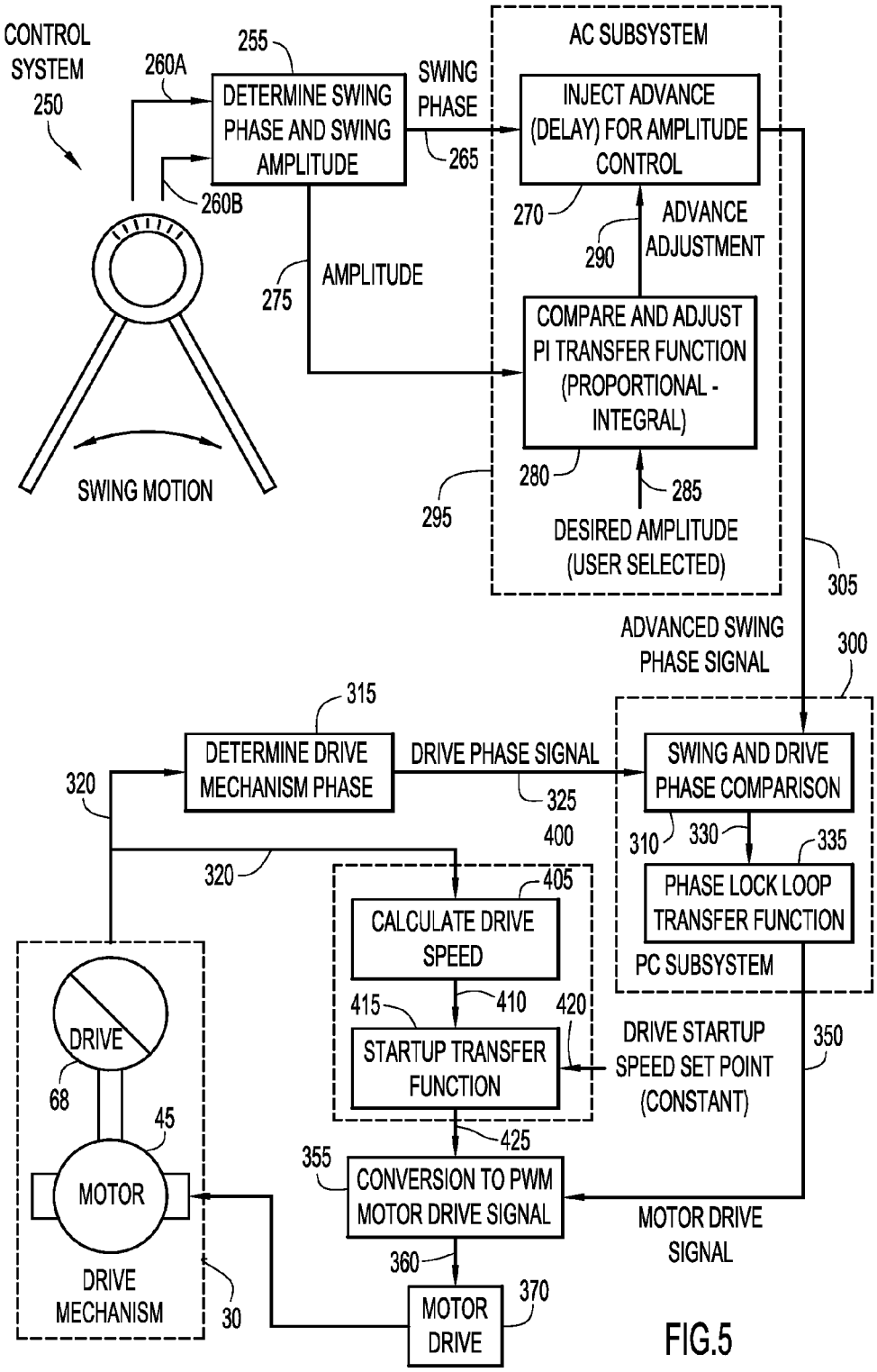
FIG. 5 illustrates a flow diagram schematically representing a control system used to control motion of the child swing of FIG. 1.
Figure 6:
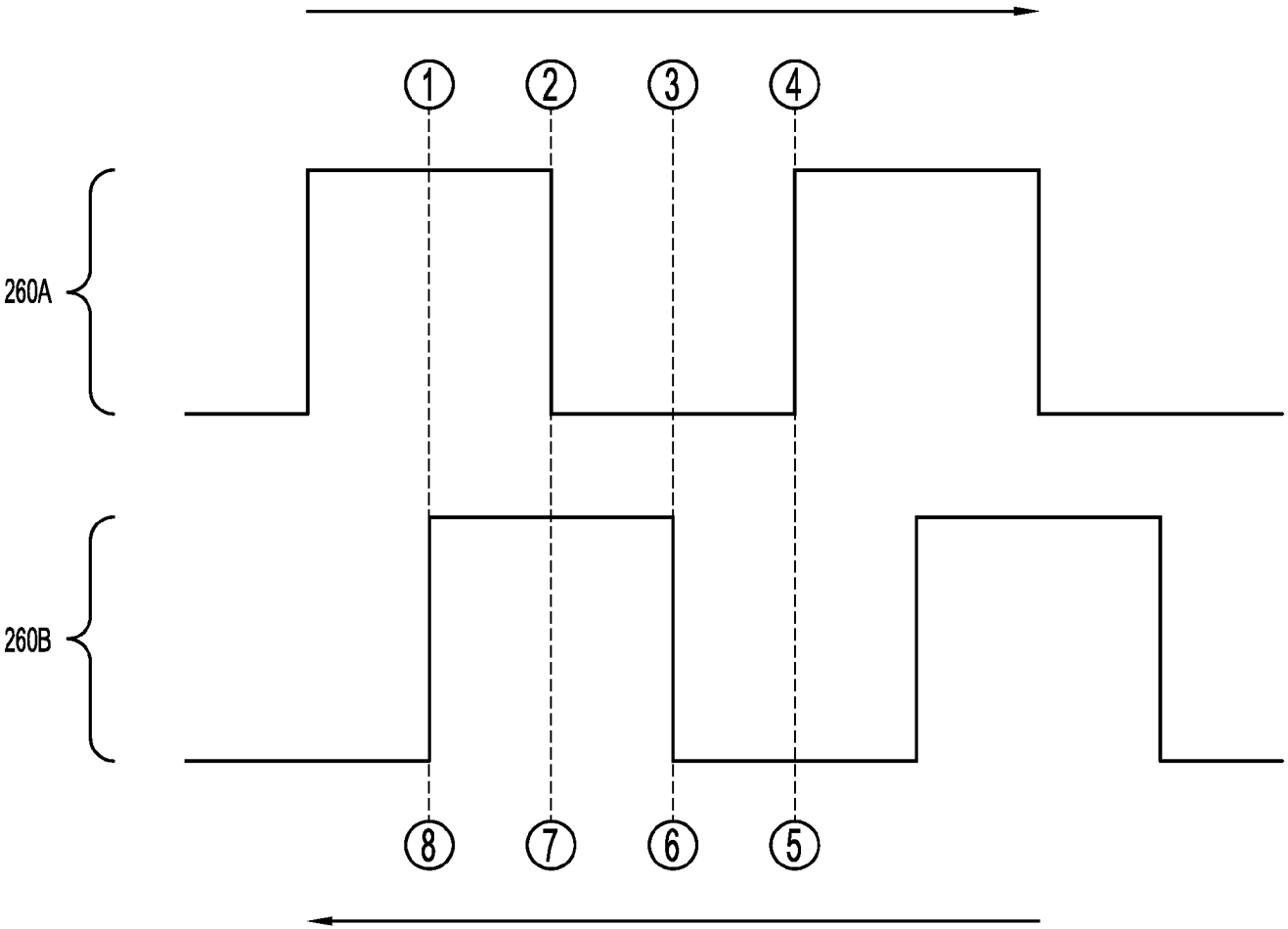
FIG. 6 illustrates two pulse trains received at the control system from a swing sensor in accordance with an embodiment of the present invention.

FIG. 5 is a detailed flow diagram illustrating the operation of the control system 250 of child swing 10. The method of FIG. 5 begins at block 255 where the control system 250 receives two pulse trains from swing sensor 110. FIG. 6 illustrates one illustrative combination of pulse trains 260A and 260B.

At block 255, the control system 250 is configured to use the relative timing of the pulses in pulse trains 260A and 260B to determine the swing arm phase (i.e., the direction in which swing arm 20 is moving). More specifically, if the pulse train 260A is leading pulse train 260B, the control system 250 determines that swing arm 20 is moving in a first direction. As soon as the control system 250 detects that pulse train 260A is following pulse train 260B, the control system determines that there has been a change in phase. A swing phase signal 265 is then provided to block 270.

The control system 250 is further configured to, at block 255, determine the actual amplitude of swing arm 20. The control system 250 is configured to determine the swing amplitude from the number of encoder counts (pulses) that are detected between each direction change (i.e., how many pulses were counted during when the swing arm 20 was going right to left or left to right). A swing amplitude signal 275 is then provided to block 280.

At block 280, the control system 250 compares the actual swing amplitude 275 to a pre-set swing amplitude 285. Based on the comparison, an adjustment signal 290 is provided to block 270. In the example of FIG. 5, blocks 270 and 280 represent an amplitude control (AC) subsystem 295.

The AC subsystem 295 uses a Proportional/Integral (PI) transfer function to generate the adjustment signal 290. More specifically, based on current and previous determined differences between the actual and desired swing amplitudes, a PI relationship is derived. As such, the adjustment signal 290 output by this PI transfer function is a time value, where the time represents the "advance" (lead) of the drive relative to the swing and is to be increased or decreased to adjust the phase control of the lead angle, in an attempt to "steer" the phase control subsystem 300 to cause the actual amplitude to achieve the desired amplitude. In some embodiments, a proportional integral derivation (PID) transfer function may be used for these operations.

Because the amplitude control subsystem 295 uses a PI transfer function, the actual swing amplitude will increase/decrease in a controlled manner. For example, amplitude control subsystem 295 may determine that there is a difference between the actual swing amplitude and the desired swing amplitude while the drive mechanism 30 is leading the swing arm 20 by an angular amount of 20 degrees. The amplitude control subsystem 295 may further determine that an angular lead of 30 degrees is needed for the actual amplitude to match the pre-set amplitude. It is undesirable to immediately increase the angular lead to the desired amount (i.e., to go immediately from 20 degrees to 30 degrees in this example) because such a rapid increase would disrupt the smooth motion of the swing. As such, the PI transfer function is configured to output a series of adjustment signals 290 over a period of time that each effect gradual increases in the angular lead so as to ensure that the seat 25 continues to smoothly follow the arcuate path, even as the angular lead increases. The proportional aspects of the PI transfer function are configured to generate a decision each time a comparison is performed in the amplitude control subsystem 295 (i.e., amplitude control subsystem 295 does not remember prior decisions) and can be viewed as a "coarse" adjustment. However, the integral aspects of the PI transfer function are configured to build upon prior decisions (i.e., amplitude control subsystem 295 remembers and uses prior decisions in this case) and can be viewed as a "fine" adjustment.

Figure 7:
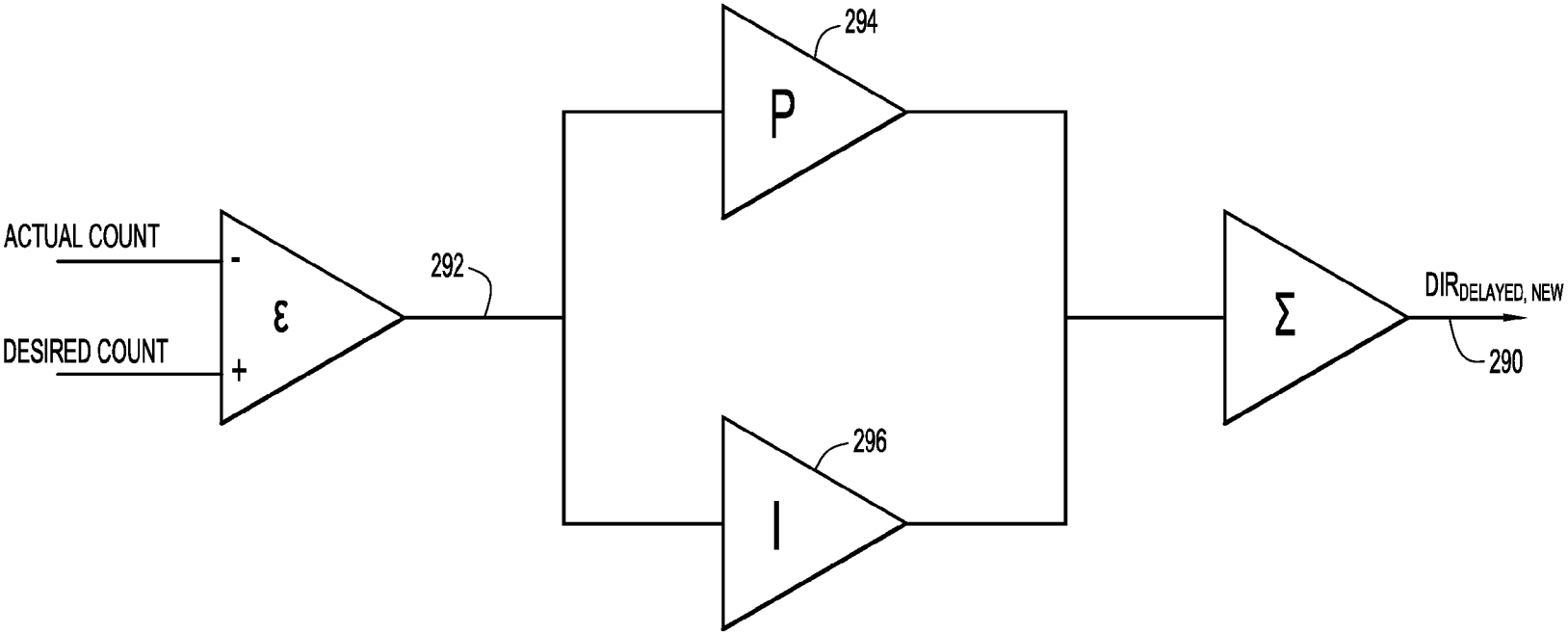
FIG. 7 illustrates a schematic diagram of a Proportional/Integral (PI) control used by an amplitude control (AC) subsystem in accordance with an embodiment of the present invention.

FIG. 7 is an example schematic diagram of the PI control executed at block 280. The error signal ($\epsilon$) 292, shown in FIG. 7, is the difference between the desired amplitude pulse count and the current maximum amplitude pulse count of the swing arm 20. The proportional control 294 takes the error signal value and multiplies it by a gain (k). Since a "negative" delay cannot be added to the system, an offset is added to the delay signal so that it would start to delay before approaching the desired amplitude count. Without this offset, the PI loop would only add delay once the desired amplitude count was reached, and thus would likely overshoot.

The integral control 296 integrates the total error over time and is limited, in certain embodiments, between a high value and a low value and may be set to 0 if outside the designated range near the desired amplitude pulse count. Without limits or a band range in place, the integral could saturate out of range if the swing arm were obstructed and not allowed to be controlled.

The new delayed signal, adjustment signal 290, is the sum of the Proportional and Integral outputs. In certain embodiments, the delay is limited to a maximum delay of a predetermined value and a minimum of 0 seconds.

At block 270, the adjustment signal 290 from the AC subsystem 295 is used to influence the operation of the phase control subsystem 300. More specifically, the adjustment signal 290 is used to modify (i.e., advance or delay) the swing phase signal 265 so that the phase control subsystem 300 believes the phase of the drive mechanism 30 is ahead or behind the phase of the swing arm 20 by the angular amount identified in the received adjustment signal. In other words, at block 270, the amplitude control subsystem 295 is configured to adjust or modify the actual swing phase and output an advanced swing phase signal 305 that represents the adjusted swing phase (i.e., the swing phase which has been advanced or delayed relative to the actual swing phase). This advanced swing phase signal 305 is then provided to block 310.

It is to be appreciated that the use of the term "advanced" to describe the swing phase signal 305 is merely for ease of description, and that the phase signal 305 may actually reflect an increase in the angular lead, a decrease in the angular lead, or no change to the angular lead. It is also to be appreciated that the amplitude control subsystem 295 may not be executed at every apex of the swing arm 20 (i.e., every half period). For example, the amplitude control subsystem 295 may be executed once every two swing arm periods.

At block 315, the control system 250 receives a pulse train 320 from the photo-interrupter 120 of drive phase sensor 115. The control system 250 is configured to, also at block 315, use the pulse train 320 to determine the phase of the drive mechanism 30, and to output a drive phase signal 325 that represents the drive phase. This drive phase signal 325 is then provided to block 310.

At block 310, the phase control subsystem 300 is configured to use the advanced swing phase signal 305 and drive phase signal 325 to compare the phase of swing arm 20 to the phase of the drive mechanism 30. As noted above, the drive mechanism 30 and swing arm 20 are in-phase when the phase of the drive mechanism 30 leads the swing arm 20 by a predetermined amount that is intended to achieve a desired swing amplitude. However, also as explained above, at block 270 an adjustment was made to the determined phase of the swing arm 20 such that, at block 310, the phase control subsystem 300 will now believe that the drive mechanism 30 and the swing arm 20 are not in-phase, and that an adjustment to the angular lead is needed to place them back into phase. Accordingly, the phase control subsystem 300 will output a phase comparison signal 330 that represents the phase difference between drive mechanism 30 and the advanced phase of swing arm 20 as perceived by the phase control subsystem 300 (i.e., how much the phase control subsystem 300 believes the drive mechanism 30 and swing arm 20 are out-of-phase as a result of the phase modification introduced by the amplitude control subsystem 295).

In certain embodiments described herein, the advanced phase signal 305 and the drive phase signal 325 may each be pulse trains. When the drive mechanism 30 and swing arm 20 are in-phase, the pulse trains 305 and 325 will be identical. However, when drive mechanism 30 and swing arm 20 are not in-phase, a phase shift will be present. The phase control subsystem 300 is configured to detect this phase shift at block 310. The output of the swing/drive comparison block 310 is a Tristate signal having a value of 0, 1, or −1. In essence, the comparison results in an output signal with a value of zero when two square wave signals are the same. The output signal will have a value of 1 or −1 if there is a different (i.e., out of phase). The value of 1 or −1 indicates which one is ahead of the other.

The phase comparison signal 330 is provided to block 335 where the phase control subsystem 300 performs a transfer function designed to influence the drive of motor 45 (i.e., speed up or slow down the motor) to align the phases of the drive mechanism 30 and swing arm 20. The transfer function executed at block 335 uses a PI control to increase/decrease the speed of motor 45 in a controlled manner. That is, the transfer function is configured to output a series of signals over a period of time that each gradually change the angular lead so as to ensure that the seat 25 continues to smoothly follow the arcuate path. The proportional aspects of the PI transfer function are configured to generate a decision each time a comparison is performed at block 310 and can be viewed as a "coarse" adjustment. However, the integral aspects of the PI control are configured to build upon prior decisions and can be viewed as a "fine" adjustment. The Tristate signal controls the amount of time that the PI transfer function is applied, and this time is related to the amount of time by which the drive and delayed swing phase differ, in an attempt to minimize this difference. In some embodiments, a proportional integral derivation (PID) transfer function may be used for these operations.

Figure 8:
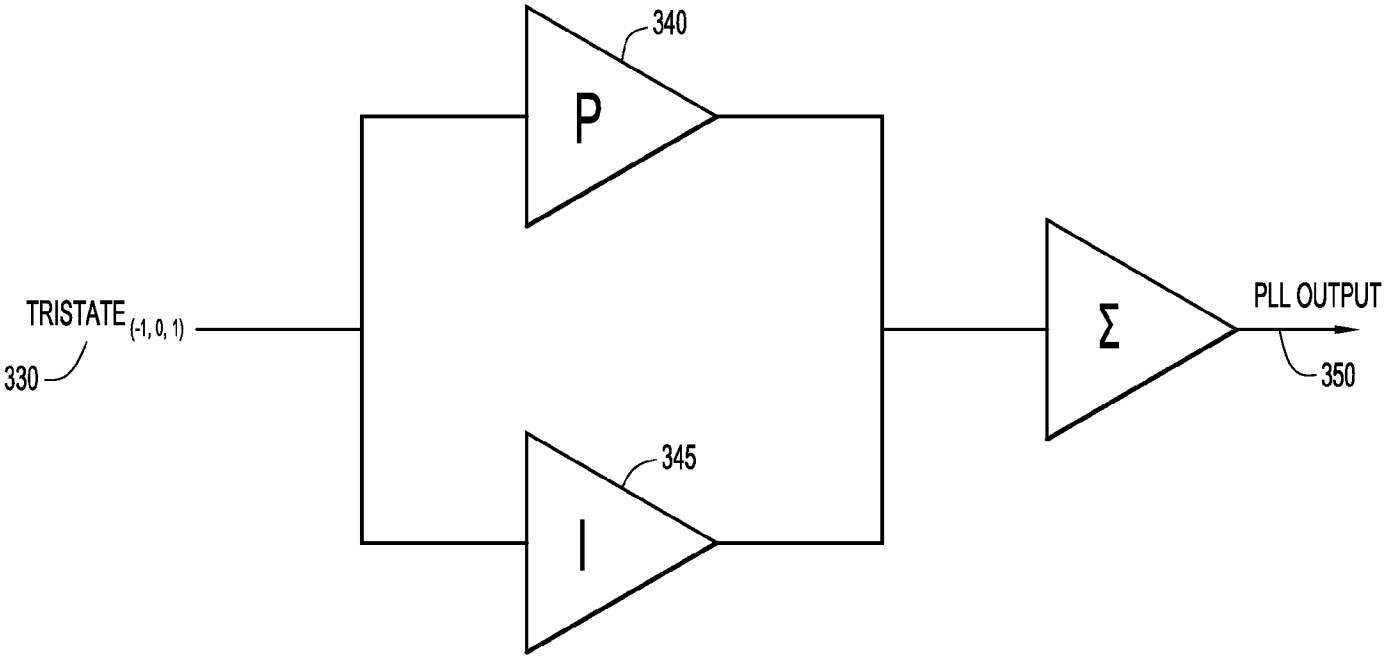
FIG. 8 illustrates a schematic diagram of a PI control used by a phase control (PC) subsystem in accordance with an embodiment of the present invention.

FIG. 8 is an example schematic diagram of the PI control executed at block 335. As shown, the proportional control 340 takes the Tristate value of −1, 0, or 1 and multiplies it by a constant k.

The integral control 345 integrates the total error over time. In certain embodiments, the result of the integral control may be limited to a maximum value.

The phase control subsystem output 350 is then the sum of the proportional and integral outputs.

In the embodiments of FIG. 5, the speed of motor 45 is regulated by pulse width modulation (PWM) of a DC power supply. As such, in certain embodiments, the phase control subsystem output 350 is provided to block 355 for conversion to a PWM motor drive signal 360. The PWM motor drive signal 360 may then be provided to block 370 and used to drive the motor 45.

In certain optional embodiments, the child swing 10 includes a startup subsystem 400 that is configured to maintain a "baseline" specified motor period in lieu of other adjustments made by the phase control subsystem 300. This optional control may be useful for improving startup transients through an integral control. At block 405, the startup subsystem 400 is configured to use the pulse train 320 from drive phase sensor 115 to calculate the speed of the drive mechanism 30 and to output a drive speed signal 410. At 415, the startup subsystem 400 uses the drive speed signal 410 and a set drive speed 420 to generate a startup motor signal 425.

In embodiments that include the startup subsystem 400 configured to match the drive mechanism speed to the swing arm natural position. More specifically, the startup subsystem 400 may execute a transfer function startup routine to generate motor drive signals that initiate motion of the child swing. The transfer function may be, for example, a PI transfer function, a PID transfer function, an integral transfer function, etc. The phase control subsystem 300 may be inactive until a predetermined swing amplitude is achieved After the predetermined swing amplitude is reached, the phase control subsystem 300 is activated and the startup subsystem 400 is deactivated. In another embodiment, the phase control subsystem 300 and startup subsystem 400 may operate simultaneously, and the phase control subsystem output 350 and startup motor signal 425 may be combined before being used to drive the motor 45.

Figure 9:
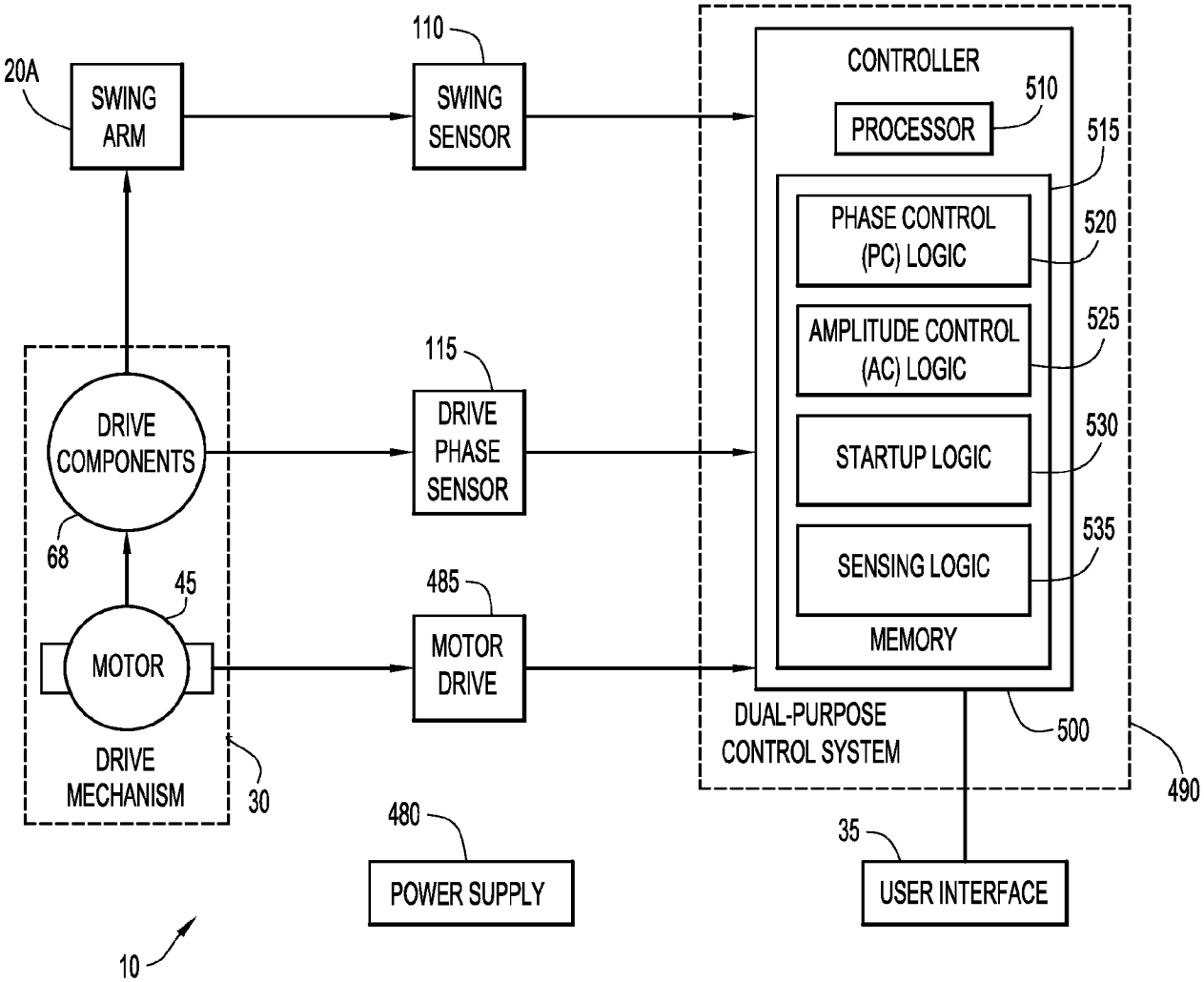
FIG. 9 is a system block diagram of the child swing of FIG. 1.

FIG. 9 is a system block diagram of one embodiment of child swing 10 shown in FIGS. 1-5. FIG. 9 schematically illustrates swing arm 20, drive mechanism 30 comprising the motor 45 and the drive components 68, user interface 35, swing sensor 110, and drive phase sensor 115, all of which have been described above. FIG. 9 also illustrates a DC power supply 480, a motor drive 485, and a dual-purpose control system 490 that may operate as described above with reference to FIG. 5. In this example, dual-purpose control system 490 comprises a controller 500 that includes a processor 510 and a memory 515. Memory 515 comprises, among other elements, phase control (PC) logic 520, amplitude control (AC) logic 525, startup logic 530, and sensing logic 535.

Memory 515 may comprise read only memory (ROM), random access memory (RAM), magnetic disk storage media devices, optical storage media devices, flash memory devices, electrical, optical, or other physical/tangible memory storage devices. The processor 510 is, for example, a microprocessor or microcontroller that executes instructions for the phase control logic 520, amplitude control logic 525, startup logic 530, and sensing logic 535. Thus, in general, the memory 515 may comprise one or more tangible (non-transitory) computer readable storage media (e.g., a memory device) encoded with software comprising computer executable instructions and when the software is executed (by the processor 510) it is operable to perform the operations described herein in connection with the phase control subsystem (through execution of phase control logic 520), the amplitude control subsystem (through execution of amplitude control logic 525), the startup routine (through execution of startup logic 530), and generation of drive phase signals and swing amplitude and phase signals from sensed pulse trains (through execution of sensing logic 535).

More specifically, the dual-purpose control system 490 is a software/controller based implementation where various software modules (phase control logic 520, amplitude control logic 525, startup logic 530, and sensing logic 535) are executable by processor 510 to perform the operations described above with reference to FIG. 5. It is to be appreciated that the arrangement shown in FIG. 9 is merely illustrative and child swing 10 may include other combinations of hardware/software components.

The dual-purpose control system in accordance with embodiments of the present invention has been described herein with reference a motor-driven child swing. It is to be appreciated that the control swing may be used in other child swings having different types of drive systems that have a detectable phase.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A child swing, comprising:

a support frame;

a child seat;

at least one swing arm coupling the child seat to the support frame;

a drive mechanism configured to impart torque to the at least one swing arm so that the child seat moves in an arcuate path;

a swing sensor configured to output one or more electrical signals representative of an actual amplitude of the child swing and representative of an actual phase or direction of the at least one swing arm;

a sensor configured to output an electrical signal representative of a phase of the drive mechanism; and a control system comprising:

an amplitude control subsystem configured to use the one or more electrical signals from the swing sensor to compare the actual amplitude of the child swing to a pre-set amplitude of the child swing to generate an adjustment signal representing a desired adjustment to the phase of the drive mechanism;

a phase control subsystem configured to use the electrical signal representative of a phase of the drive mechanism and the adjustment signal to generate a motor drive signal configured to cause the desired adjustment to the phase of the drive mechanism.

2. The child swing of claim 1, wherein the amplitude control subsystem uses a Proportional/Integral (PI) transfer function to generate the adjustment signal.

3. The child swing of claim 1, wherein the amplitude control subsystem uses a proportional integral derivation (PID) transfer function to generate the adjustment signal.

4. The child swing of claim 1, wherein the phase control subsystem uses a PI transfer function to generate the motor drive signal.

5. The child swing of claim 1, wherein the phase control subsystem uses a PID transfer function to generate the motor drive signal.

6. The child swing of claim 1, wherein the swing sensor is an encoder configured to output two pulse trains representative of the actual amplitude of the child swing and representative of the actual phase of the at least one swing arm.

7. The child swing of claim 1, wherein the control system further comprises:

a startup subsystem configured to initiate motion of the at least one swing arm, wherein the amplitude control subsystem and the phase control subsystems are disabled until the child swing reaches a predetermined amplitude.

8. The child swing of claim 7, wherein the startup subsystem uses a transfer function to generate motor drive signals that initiate motion of the child swing.

9. A control method for a child swing comprising:

comparing an actual amplitude of the child swing to a pre-set amplitude of the child swing;

generating, based on the comparison, an adjustment signal representing a desired adjustment to a phase of a drive mechanism of the child swing; and generating, based on an electrical signal representative of a phase of the drive mechanism and the adjustment signal, a motor drive signal configured to cause the desired adjustment to the phase of the drive mechanism.

10. The method of claim 9, wherein generating the adjustment signal comprises:

executing a Proportional/Integral (PI) transfer function to generate an adjustment signal representing an advance or delay to be applied to the drive mechanism phase.

11. The method of claim 9, wherein generating the adjustment signal comprises:

executing a proportional integral derivation (PID) transfer function to generate the adjustment signal.

12. The method of claim 9, wherein generating the motor drive signal comprises:

executing a Proportional/Integral (PI) transfer function to generate the motor drive signal.

13. The method of claim 9, wherein generating the motor drive signal comprises:

executing a PID transfer function to generate the motor drive signal.

14. The method of claim 9, further comprising:

receiving, from a swing sensor, one or more electrical signals representative of the actual amplitude of the child swing and representative of an actual phase of at least one swing arm; and receiving, from a drive phase sensor, an electrical signal representative of the phase of the drive mechanism.

15. The method of claim 14, wherein the swing sensor is an encoder and wherein receiving the one or more electrical signals representative of the actual amplitude of the child swing and representative of the actual phase of the at least one swing arm comprises:

receiving two pulse trains representative of the actual amplitude of the child swing and representative of the actual phase of the at least one swing arm.

16. The method of claim 9, further comprising:

executing a transfer function startup routine to generate motor drive signals that initiate motion of the child swing.

17. One or more computer readable storage media encoded with software comprising computer executable instructions and when the software is executed operable to:

compare an actual amplitude of a child swing to a pre-set amplitude of the child swing;

generate, based on the comparison, an adjustment signal representing a desired adjustment to a phase of a drive mechanism of the child swing; and generate, based on an electrical signal representative of a phase of the drive mechanism and the adjustment signal, a motor drive signal configured to cause the desired adjustment to the phase of the drive mechanism.

18. The computer readable storage media of claim 17, wherein the instructions operable to generate the adjustment signal comprise instructions operable to:

execute a Proportional/Integral (PI) transfer function to generate an adjustment signal representing an advance or delay to be applied to the drive mechanism phase.

19. The computer readable storage media of claim 17, wherein the instructions operable to generate the adjustment signal comprise instructions operable to:

execute a proportional integral derivation (PID) transfer function to generate the adjustment signal.

20. The computer readable storage media of claim 17, wherein the instructions operable to generate the motor drive signal comprise instructions operable to:

execute a Proportional/Integral (PI) transfer function to generate the motor drive signal.

21. The computer readable storage media of claim 17, wherein the instructions operable to generate the motor drive signal comprise instructions operable to:

execute a PID transfer function to generate the motor drive signal.

22. The computer readable storage media of claim 17, further comprising instructions operable to:

receive, from a swing sensor, one or more electrical signals representative of the actual amplitude of the child swing and representative of an actual phase of at least one swing arm; and receive, from a drive phase sensor, an electrical signal representative of the phase of the drive mechanism.

23. The computer readable storage media of claim 22, wherein the swing sensor is an encoder and wherein the instructions operable to receive the one or more electrical signals representative of the actual amplitude of the child swing and representative of the actual phase of the at least one swing arm comprise instructions operable to:

receive two pulse trains representative of the actual amplitude of the child swing and representative of the actual phase of the at least one swing arm.

24. The computer readable storage media of claim 17, further comprising instructions operable to:

execute a transfer function startup routine to generate motor drive signals that initiate motion of the child swing.

25. A controller for a child swing comprising:

a memory; and a processor configured to:

compare an actual amplitude of the child swing to a pre-set amplitude of the child swing;

generate, based on the comparison, an adjustment signal representing a desired adjustment to the phase of a drive mechanism of the child swing; and generate, based on an electrical signal representative of a phase of the drive mechanism and the adjustment signal, a motor drive signal configured to cause the desired adjustment to the phase of the drive mechanism.

26. The controller of claim 25, wherein to generate the adjustment signal the processor is configured to:

execute a Proportional/Integral (PI) transfer function to generate an adjustment signal representing an advance or delay to be applied to the drive mechanism phase.

27. The controller of claim 25, wherein to generate the adjustment signal the processor is configured to:

execute a proportional integral derivation (PID) transfer function to generate the adjustment signal.

28. The controller of claim 25, wherein to generate the motor drive signal the processor is configured to:

execute a Proportional/Integral (PI) transfer function to generate the motor drive signal.

29. The controller of claim 25, wherein to generate the motor drive signal the processor is configured to:

execute a PID transfer function to generate the motor drive signal.

30. The controller of claim 25, wherein the processor is further configured to:

receive, from a swing sensor, one or more electrical signals representative of the actual amplitude of the child swing and representative of an actual phase of at least one swing arm; and receive, from a drive phase sensor, an electrical signal representative of the phase of the drive mechanism.

* * * * *